US007735661B1

(12) United States Patent
Sumner et al.

(10) Patent No.: US 7,735,661 B1
(45) Date of Patent: Jun. 15, 2010

(54) KITCHEN COOKING RECEPTACLE DRAINING RACK

(76) Inventors: Wallace Maurice Sumner, 1697 Hillside St., Marietta, GA (US) 30066; Marsha Lueth Sumner, 1697 Hillside St., Marietta, GA (US) 30066

( * ) Notice: Subject to any disclaimer, the term of this patent is extended or adjusted under 35 U.S.C. 154(b) by 360 days.

(21) Appl. No.: 12/029,145

(22) Filed: Feb. 11, 2008

Related U.S. Application Data

(60) Provisional application No. 60/890,979, filed on Feb. 21, 2007.

(51) Int. Cl.
*A47J 47/20* (2006.01)
*B65D 6/04* (2006.01)

(52) U.S. Cl. ..... 211/41.3; 4/638; 4/656; 220/487

(58) Field of Classification Search ..... 211/10, 211/11, 41.1–41.6, 41.8, 41.11, 44, 50, 74, 211/85.15, 85.25, 85.31, 85.5, 125, 126.13, 211/181.1; 4/631, 637, 638, 654, 656; D32/55, D32/56; 220/485–488, 572; 312/228.1; 134/200, 201; 108/1, 29, 32; 248/175, 231.81, 248/689; 34/237–240
See application file for complete search history.

(56) References Cited

U.S. PATENT DOCUMENTS

| | | | | | |
|---|---|---|---|---|---|
| 839,906 | A | * | 1/1907 | Timberlake | 211/41.2 |
| 910,057 | A | * | 1/1909 | Greener | 248/175 |
| 1,224,838 | A | * | 5/1917 | Blissman | 211/72 |
| 1,266,245 | A | * | 5/1918 | Fuhrmann | 211/41.11 |
| D52,356 | S | * | 8/1918 | Strelak | D6/566 |
| 1,348,792 | A | * | 8/1920 | Feingold | 211/41.4 |
| 1,533,891 | A | * | 4/1925 | Oles | 4/656 |
| 1,679,594 | A | * | 8/1928 | Andrews | 220/6 |
| 1,853,888 | A | * | 4/1932 | Williams | 211/41.1 |
| 2,022,591 | A | * | 11/1935 | Everitt | 312/229 |
| 2,039,927 | A | * | 5/1936 | Poglein | 211/13.1 |
| 2,062,802 | A | * | 12/1936 | Walker | 211/44 |
| 2,238,451 | A | * | 4/1941 | Roth | 211/40 |
| 2,588,529 | A | * | 3/1952 | Hume | 242/139 |
| 2,841,288 | A | * | 7/1958 | Field et al. | 211/41.4 |
| D189,982 | S | | 3/1961 | Christoffersen | |
| D192,477 | S | | 3/1962 | Chapman | |
| D215,170 | S | | 9/1969 | Bachand | |
| 3,627,141 | A | * | 12/1971 | Kurland et al. | 211/44 |
| 3,952,875 | A | | 4/1976 | Lombardo | |
| 4,033,461 | A | | 7/1977 | Nevai | |
| 4,053,954 | A | | 10/1977 | Chapman | |
| 4,169,638 | A | * | 10/1979 | Cirasuolo et al. | 312/229 |
| 4,212,400 | A | | 7/1980 | Buchsteiner | |
| 4,221,299 | A | | 9/1980 | Taylor | |
| 4,254,881 | A | * | 3/1981 | Hard | 211/85.29 |
| 4,328,899 | A | | 5/1982 | Krusche | |
| 4,726,475 | A | | 2/1988 | Ferenzi | |
| 4,778,064 | A | * | 10/1988 | Gold | 211/41.14 |
| 5,012,934 | A | * | 5/1991 | Newhall | 211/41.3 |

(Continued)

*Primary Examiner*—Michael Safavi
*Assistant Examiner*—Joshua Rodden

(57) ABSTRACT

An adjustable kitchen draining rack for spanning across a sink basin and supporting a plurality of cooking receptacles that contain hot or cold flowable oils and/or greases, and allowing said cooking receptacles to safely and efficiently drain into a disposable collection receptacle thus preventing said oils and/or greases from entering sink basin drain systems and avoiding costly sink drain and piping clogs, costly clogging and damage to public sewer systems and equipment, and harm to the environment, while reducing water and energy consumption.

1 Claim, 3 Drawing Sheets

U.S. PATENT DOCUMENTS 5,660,284 A * 8/1997 Vaughn ..... 211/41.1
D416,119 S * 11/1999 Newhall ..... D32/55
D416,364 S * 11/1999 Newhall ..... D32/55
6,062,397 A * 5/2000 Licari ..... 211/41.3
6,357,605 B1 3/2002 Martorella
6,543,069 B1 4/2003 Nelson
2001/0045401 A1 11/2001 Deiss
2005/0040120 A1 2/2005 Pine
2006/0138063 A1 6/2006 Johnson
2006/0237379 A1 10/2006 Yang
2006/0283817 A1 12/2006 Yang
2006/0289372 A1 * 12/2006 Yang et al. ..... 211/41.3

* cited by examiner

KITCHEN COOKING RECEPTACLE DRAINING RACK

The present invention relates to an extendable, retractable, adjustable and washable kitchen cooking receptacle draining rack that spans across a kitchen sink basin. The present invention is positioned above a disposable collection receptacle located in a kitchen sink basin, or can be positioned atop a countertop or other horizontal surface with a disposable collection receptacle located beneath. The purpose of the present invention is to support cooking receptacles and the like, and at the same time allowing the safe and efficient draining and consequent collection of flowable cooking oils, greases, fats, juices and other residuals from said cooking receptacles, thus preventing costly kitchen sink basin drain piping clogs, costly clogging and damage to public sewer systems and equipment, and harm to the environment. In addition the present invention will reduce water and energy consumption as described later in this document.

BACKGROUND OF THE INVENTION

Residential and commercial kitchens use a variety of cooking oils and greases in the preparation of certain food items. These food items are cooked in these oils and greases in common kitchen cooking receptacles such as frying pans, broiler pans, deep-fryers, and pots and the like. Once a food item has finished cooking and been removed from its cooking receptacle, there is a generous amount of residual cooking oil and/or grease that undesirably remains in the cooking receptacle.

Many food items such as beef and pork products (i.e. hamburgers, bacon and the like) are cooked without the use of cooking oils or greases. During the cooking process, these food items produce their own residual oils and/or greases. Once a food item such as this has finished cooking and been removed from its cooking receptacle, there is a generous amount of the food item's own residual oil and/or grease that undesirably remains in the cooking receptacle.

Still some food items are cooked in cooking oils or greases wherein the combination of the cooking oil or grease and the food item's residual oil and/or grease undesirably remains in the receptacle.

Once the heating source to the cooking receptacle is terminated, the remaining cooking oil or grease, or the food item's residual oil and/or grease, or the combination of both will eventually cool. Upon cooling, the cooking oil will remain in its original liquid state. Upon cooling, the cooking grease will undesirably congeal. Upon cooling, the food item's residual oil will generally remain as a liquid, and the food item's residual grease will undesirably congeal, or a combination of both.

In any of the aforementioned scenarios the residuals remaining in the cooking receptacle will require disposal. Usually said disposal occurs later at a convenient time which unfortunately allows congealment when greases are involved. Once congealment has formed, the cooking receptacle must be undesirably reheated to change the congealment back into a flowable form in order to allow complete gravity drainage of the cooking receptacle. This reheating is costly and a waste of energy.

Currently there are several typical methods employed in the drainage and disposal of these residuals from cooking receptacles.

One method which is time consuming and cumbersome consists of holding the cooking receptacle over a sink basin and emptying the cooking receptacle's residual contents directly into the sink basin's drain piping system. Using this method will eventually clog the sink basin's drain piping system requiring costly repairs. This method also undesirably allows these residual oils and greases to enter septic tank systems and public sewer systems and cause costly equipment repairs. It is even worse when congealed matter is involved as it must be undesirably reheated and returned back to a liquid state in order for it to gravity flow into the sink basin's drain piping system, and then this liquid cools and congeals again once flowing into and contacting the sink basin's drain piping system creating more serious clogging. Frequently hot water is then introduced into the sink basin's drain piping system based on the operator's premise that this action will eliminate or drastically reduce any clogging. Not only is this action a costly waste of water, it is also a costly waste of energy that was used to heat the water and reheat the congealed matter.

A second method consists of directly placing the cooking receptacles into a household dishwasher. This method is also undesirable for the same reasons explained above.

A third method consists of holding the cooking receptacle over a disposable collection receptacle such as an empty coffee can or an aluminum foil receptacle, or the like, and emptying the cooking receptacle's residual contents directly into the disposable collection receptacle. This method is undesirable as it is also time consuming, cumbersome and requires a steady hand in order to not allow any of the cooking receptacle's residual contents to undesirably enter the sink basin's drain piping system or onto other surfaces.

A fourth method which is also time consuming and cumbersome consists of holding the cooking receptacle over a trash receptacle or the like and emptying the cooking receptacle's residual contents directly into the trash receptacle. This method is undesirable as there is a potential for leaks from the trash receptacle's liner bag which can create a slipping hazard or damage flooring and/or carpeting.

When a clog does develop in a kitchen sink basin's drain piping system, sometimes costly toxic chemicals are introduced into the drain piping system followed by more water to break up the clog. These chemicals ultimately harm the environment and can damage kitchen sink basin and drain components and public sewer system equipment.

A need therefore obviously exists for a kitchen device that would save energy, be efficient, be economic and be safe in the handling and draining of a cooking receptacle's residual oils and/or greases and their consequent collection and disposal. This device would generally vertically support hot or cold cooking receptacles and the like, and allow the cooking receptacles' residual fluids to safely drain into a separate remote disposable collection receptacle located beneath said kitchen device. Said kitchen device would eliminate oil and/or grease—causing clogs and associated repairs. Said kitchen device would save water and energy and protect the environment. A need also exists for a kitchen device that would make draining easier for elderly, handicapped and arthritis stricken users. It will become readily apparent that the present invention is not limited to only kitchen applications. For example the device could also be used in manufacturing and industrial facilities where draining and cooling of parts are required.

BRIEF SUMMARY OF THE INVENTION

Standard kitchen dish racks are generally made of lightweight wood, plastic or plastic coated wire/rod. These types of materials that are used for dish racks are designed strictly for very low temperature applications. These types of dish rack materials would not be suitable for the significantly higher temperatures associated with a hot kitchen receptacle containing hot oils and/or greases. The present invention would be constructed of materials, including any coatings, that are suitable for these higher temperatures. The present invention would also be designed and materially constructed to resist deflection while spanning across a sink basin and simultaneously supporting a plurality of cooking receptacles to be drained.

In the preferred embodiment the present drain rack invention would be made operable by first centering and positioning a disposable collection receptacle upon a sink basin's interior bottom surface. Next the present invention would be located above the collection receptacle and allowed to span inclined across the sink basin. The present invention would be supported upon a double sink basin dividing partition and adjacent countertop sink edge. If necessary the drain rack can be horizontally extended or retracted in order for the drain rack to be properly supported depending on the width of the sink basin. Next, cooking receptacle separating members are placed into position that will properly accommodate the widths and configurations of the cooking receptacles to be drained. A hot cooking receptacle containing hot oils and/or greases can now be positioned generally vertically between said separating members thus allowing the hot oils and/or greases to easily flow by gravity into the collection receptacle, and therefore empty the cooking receptacle. A plurality of cooking receptacles having different widths and configurations can be simultaneously placed in the drain rack for draining by merely properly positioning additional said separating members. The cooking receptacles may be left in the drain rack in order to cool. Once the cooking receptacles and drain rack are removed, the collection receptacle may be properly disposed. The present drain rack invention may also be used to drain other kitchen utensils such as dishes and bowls and the like. The present invention may also be used to support the operation of a strainer basket, a funnel, a chop board, a condiment drainer or a cookbook.

Prior art U.S. Pat. No. 4,726,475 to Ferenzi teaches a kitchen dish drain basket with extendable and retractable sides that can accommodate kitchen pots as well as dishes and glassware and can be used within sink basins or upon countertops. However Ferenzi's design does not provide for the basket to be supported across the sink basin or above a disposable collection receptacle. Ferenzi's design does not provide for the proper collection of hot oils and/or greases for later disposal. Prior art U.S. D215,170 to Bachand teaches a combination kitchen sink tray and dish drainer supported upon parallel sink walls but is not designed to vertically support and drain hot cooking receptacles containing hot oils and/or greases and collect said oils and/or greases for later disposal. Prior art U.S. Pat. No. 4,053,954 to Chapman teaches a bathtub caddy supported on the tub's parallel walls with the caddy supporting miscellaneous bathing items. Chapman's caddy is not designed to vertically support and drain hot cooking receptacles containing hot oils and/or greases over a kitchen sink basin and collect said hot oils and/or greases for later disposal. Prior art U.S. Pat. No. 4,033,461 to Nevai teaches a combination kitchen sink cleaning and draining rack supported on parallel sink walls but is not designed to vertically support and drain hot cooking receptacles containing hot oils and/or greases and collect said hot oils and/or greases for later disposal. Prior art U.S. Pat. No. 6,543,069 to Nelson teaches an extendable kitchen dish drain rack but is not designed to vertically support and drain hot cooking receptacles containing hot oils and/or greases over a sink basin and collect said hot oils and/or greases for later disposal. Prior art U.S. Pat. No. 4,169,638 to Cirasuolo teaches an extendable kitchen drain board for a countertop but is not designed to vertically support and drain hot cooking receptacles containing hot oils and/or greases over a sink basin and collect said hot oils and/or greases for later disposal. Prior art U.S. D189,982 to Christoffersen teaches an ornamental design for a storage rack that could be placed above or in a kitchen sink basin but is not designed to vertically support and drain hot cooking receptacles containing hot oils and/or greases and collect said hot oils and/or greases for later disposal. Prior art U.S. D192,477 to Chapman teaches a dish drainer basket that can rest upon a flat surface but is not designed to vertically support and drain hot cooking receptacles containing hot oils and/or greases and collect said hot oils and/or greases for later disposal. Prior art U.S. Pat. No. 3,952,875 to Lombardo teaches a collapsible dish rack that uses a bottom drain pad but is not designed to vertically support and drain hot cooking receptacles containing hot oils and/or greases and collect said hot oils and/or greases for later disposal. Prior art U.S. Pat. No. 6,357,605 to Martorella teaches a device for drying objects and in particular plates, pots, kitchen utensils and silverware. Martorella's device is collapsible, and has an adjustable rack and a catch basin, but is designed to rest upon a countertop and allow the catch basin to discharge into a sink basin. If greases were to congeal within the catch basin, the catch basin would need to be heated in order for the greases to become flowable and properly discharge into a collection receptacle (which is not mentioned because the design was not intended for oil and/or grease draining). Prior art U.S. Pat. No. 4,328,899 to Krusche teaches a collapsible crockery and glassware stand but is not designed to vertically support and drain hot cooking receptacles containing hot oils and/or greases and collect said hot oils and/or greases for later disposal. Prior art U.S. Pat. No. 4,221,299 to Taylor teaches a folding dish drainer designed to rest upon a countertop but is not designed to vertically support and drain hot cooking receptacles containing hot oils and/or greases and collect said hot oils and/or greases for later disposal. Prior art U.S. Pat. No. 4,212,400 to Buchsteiner teaches a foldable stand for drying utensils and can be supported upon a horizontal surface. However the stand design does not allow for the stand to be supported upon a double sink basin dividing partition and adjacent countertop edge. In addition the stand is not designed to vertically support and drain hot cooking receptacles containing hot oils and/or greases and collect said hot oils and/or greases for later disposal. Prior art US 2001/0045401 (application Ser. No. 09/878,665) to Deiss teaches a dish rack mainly intended for a household dishwasher and comprises vertical support guides for kitchen dishes, bowls and cooking receptacles. However Deiss's design is not intended for sink basin use, or for the draining of hot cooking receptacles containing hot oils and/or greases or for the collection of said hot oils and/or greases for later disposal. Prior art US 2005/0040120 (application Ser. No. 10/642,020) to Pine teaches an expandable dish drain rack intended for countertop use and capable of discharging into a sink basin. However Pine's device is not designed to vertically support and drain hot cooking receptacles containing hot oils and/or greases and collect said hot oils and/or greases for later disposal. Prior art US 2006/0138063 (application Ser. No. 11/234,776) to Johnson teaches a wall mounted and stowable dish rack that can be cantilevered over a sink basin in order for drain water to discharge into a sink basin. However Johnson's device is not designed to vertically support and drain hot cooking receptacles containing hot oils and/or greases and collect said hot oils and/or greases for later disposal. In addition, if the device was able to discharge hot oils and/or greases into a collection receptacle in the sink basin, a safety hazard would be created by the splashing of said hot oils and/or greases from high overhead. Prior art US 2006/0237379 (application Ser. No. 11/113,898) to Yang teaches an adjustable dish rack for resting on a horizontal surface with the ability to support and drain various kitchen receptacles. However Yang's device is not designed to vertically support and drain hot cooking receptacles containing hot oils and/or greases and collect said hot oils and/or greases for later disposal. Prior art US 2006/0283817 (application Ser. No. 11/157,302) to Yang teaches a dish rack with a water drainage discharge spout that can be used within a sink basin or adjacent to a sink basin. However Yang's device is not designed to vertically support and drain hot cooking receptacles containing hot oils and/or greases and collect said hot oils and/or greases for later disposal.

DETAILED DESCRIPTION OF THE INVENTION

Figure 1:
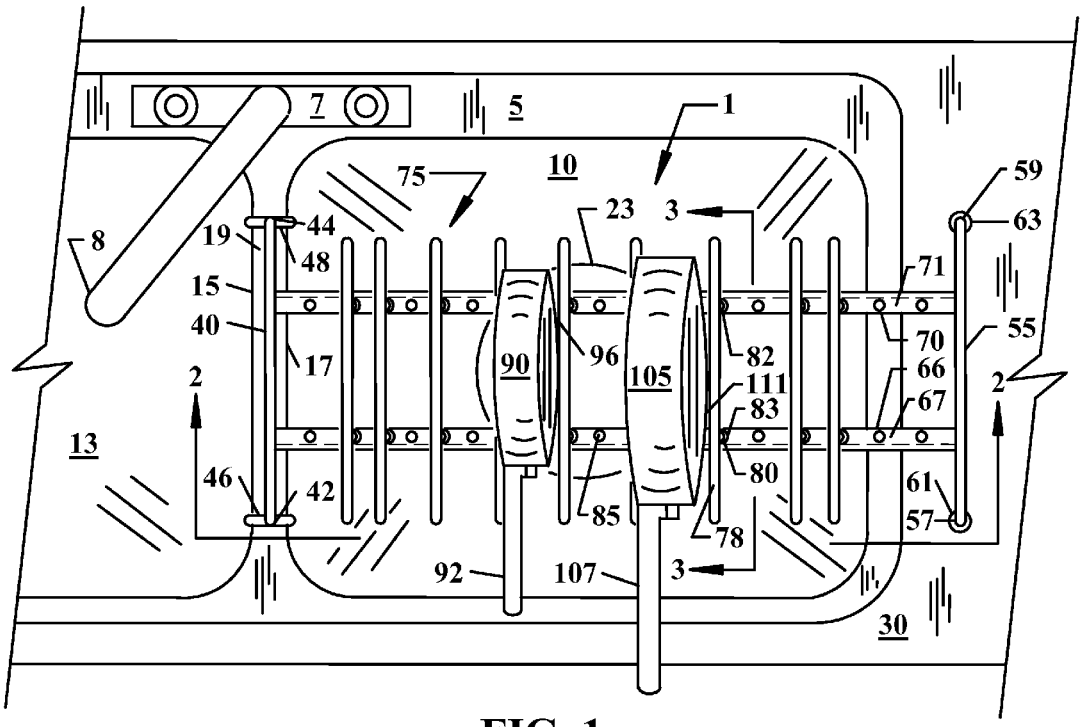
FIG. 1 is a plan view depicting the present invention spanning across a sink basin with a collection receptacle located beneath. The present invention is shown in operation supporting a plurality of cooking receptacles to be drained.

FIG. 1 is a plan view depicting the present invention drain rack device 1 spanning across a right sink basin 10 that is opposite a left sink basin 13, both being part of a double sink unit 5. Sink unit 5 is located within a countertop 30. Sink unit 5 comprises a water faucet assembly 7 and a pivotal faucet spout 8. A collection receptacle 23 (not being claimed) is shown located beneath drain rack device 1.

FIG. 1 shows an inclined span member 66 that is parallel to an inclined span member 70. Both inclined span members 66 and 70 are identical and inclined at the same angle, and are supported by a high rack support 55 and a low rack support 40. Inclined span members 66 and 70 may be of structural channel construction or other structural shapes and are in permanent communication with high and low supports 55 and 40 respectively. High support 55 and low support 40 may be constructed of solid wire, rod or other structural shape. Low support 40 is supported upon a sink basins partition 19. High support 55 is supported upon the top surface of countertop 30.

FIG. 1 shows inclined span members 66 and 70 comprised of a parallel and oppositely located series of randomly spaced openings 85 of equal size. Openings 85 are holes drilled perpendicular to inclined span members 66 and 70. Openings 85 are drilled completely through inclined span members 66 and 70.

FIG. 1 shows a plurality of identical kitchen receptacle separating members 75 which support and separate cooking receptacles such as medium size frying pan 90 and large size frying pan 105 during the draining of their residual oils and/or greases. Kitchen receptacle separating members 75 are each comprised of a horizontal member 78, a proximal leg member 80 and a distal leg member 82. Both leg members 80 and 82 may be inserted into any oppositely located pair of openings 85. A separating member 75 is predeterminedly positioned above inclined span members 66 and 70. Leg members 80 and 82 are then simultaneously inserted into a pair of oppositely located openings 85—one opening located on inclined span member 66 and the other opening located on inclined span member 70.

Figure 2:
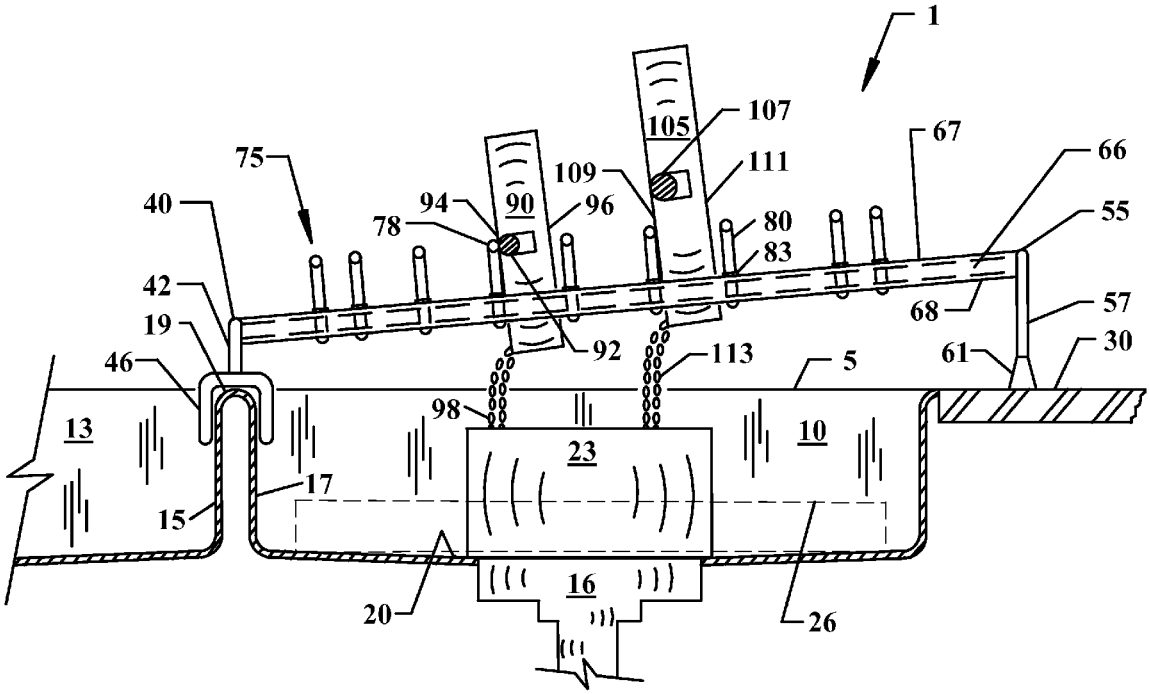
FIG. 2 is a sectional view of FIG. 1 depicting the present invention spanning across a sink basin and supporting a plurality of cooking receptacles that are draining into a collection receptacle.

FIG. 2 is a sectional view of drain rack device 1 spanning across right sink basin 10, taken from FIG. 1. FIG. 2 depicts a plurality of kitchen receptacle separating members 75 positioned to accommodate kitchen receptacles of different widths and diameters. A collection receptacle 23 is used to collect draining oils and/or greases from a small quantity of kitchen receptacles, while a larger collection receptacle 26 (not being claimed) may be required for a larger quantity of kitchen receptacles.

FIG. 2 shows high rack support 55 which is comprised of proximal leg member 57 and distal leg member 59 (shown in FIG. 1) both of which are identical to one another. Leg member 57 is inserted into protective surface cushion 61 which rests on the top surface of countertop 30. Leg member 59 is inserted into protective surface cushion 63 (shown in FIG. 1) which rests on the top surface of countertop 30.

FIG. 2 shows low rack support 40 which is comprised of proximal leg member 42 and distal leg member 44 (shown in FIG. 1) both of which are identical to one another. Leg member 42 is in communication with a U-shaped sink partition support 46. Leg member 44 is in communication with a U-shaped sink partition support 48 (shown in FIG. 1). Both partition supports 46 and 48 are identical and rest upon the top surface of sink basins partition 19, and against left sink basin partition wall 15 and right sink basin partition wall 17.

Example

The method of use for the simultaneous draining of two frying pans is initially comprised of placing collection receptacle 23 in the center of right sink basin 10. A first kitchen receptacle separating member 75 is predeterminedly inserted into inclined span members 66 and 70 and placed into position above collection receptacle 23. A medium size frying pan 90 with a frying pan handle 92 contains an amount of flowable residual hot oils and/or greases 98. Handle 92 is used to transport frying pan 90 toward said first separating member 75. Once frying pan 90 is above collection receptacle 23, said frying pan is manually tilted so that the bulk amount of said oils and/or greases 98 gravity drains into collection receptacle 23. Then said frying pan 90 is placed against said first separating member 75 and supported by allowing a front circular rim 94 of said frying pan 90 to rest tilted against said first horizontal member 78 of said separating member 75. At the same time said circular rim 94 is allowed to be supported upon inclined span members 66 and 70. A second separating member 75 is then placed into a predetermined position behind frying pan 90 so that a horizontal member 78 of this second separating member 75 is as near as possible to a rear circular rim 96 of said frying pan 90 in order to avoid said frying pan 90 becoming dislodged during draining. A large size frying pan 105 with a frying pan handle 107 now follows the same method sequence as frying pan 90. Frying pan 105 comprises a front circular rim 109 and a rear circular rim 111.

FIG. 2 depicts a right sink basin drain assembly 16. The object of draining oils and/or greases into collection receptacles 23 or 26 is to avoid said oils and/or greases from undesirably entering drain assembly 16. Once the collection of oils and/or greases is completed, collection receptacles 23 or 26 can be properly disposed. Collection receptacles 23 and 26 rest upon right sink basin bottom surface 20.

Figure 3:
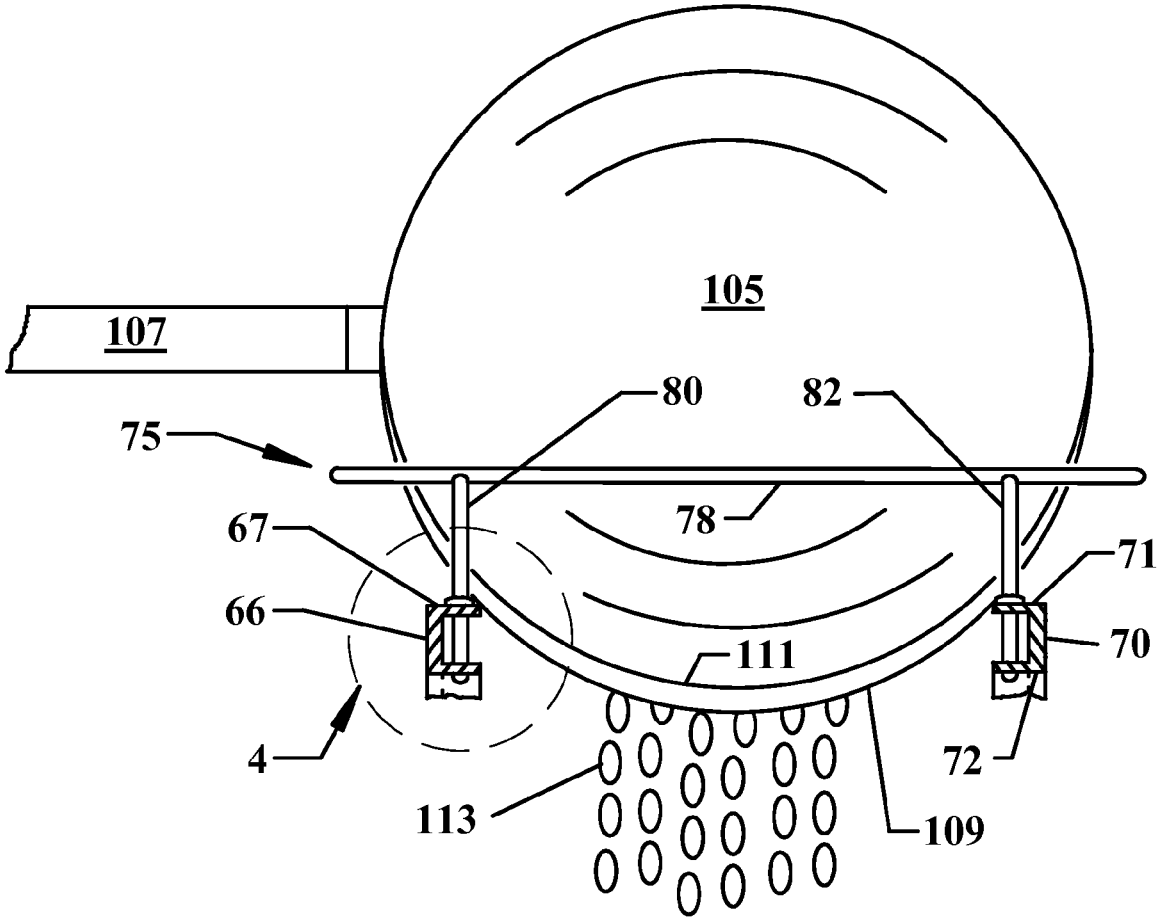
FIG. 3 is an enlarged sectional view taken from FIG. 1 depicting a draining cooking receptacle that is supported by the present invention.

FIG. 3 is a sectional view taken from FIG. 1 and shows large size frying pan 105 and its handle 107 placed into proper position for the gravity draining of flowable residual hot oils and/or greases 113. A kitchen receptacle separating member 75 with leg members 80 and 82 is predeterminedly located as near as possible to rear circular rim 111. Front circular rim 109 is supported by both inclined span members 66 and 70. Depending upon the outer and bottom configuration of frying pan 105, or any other cooking receptacle, rear circular rim 111 may also lend itself to being supported by both inclined span members 66 and 70 as well.

Figure 4:
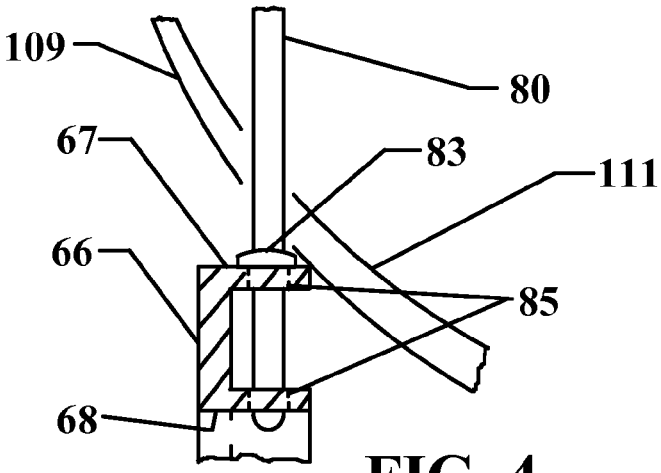
FIG. 4 is an enlarged detail taken from FIG. 3.

FIG. 4 is an enlarged detail taken from FIG. 3 and shows a front circular rim 109 supported by a top flange portion 67 of inclined span member 66 (the opposite side of the detail comprises front circular rim 109 supported by a top flange portion 71 of inclined span member 70 as shown in FIG. 3). Openings 85 allow leg member 80 to be inserted through top flange portion 67 and a bottom flange portion 68 (the opposite side of the detail comprises openings 85 which allow leg member 82 to be inserted through top flange portion 71 and a bottom flange portion 72 as shown in FIG. 3). All leg members 80 and 82 of all separating members 75 comprise a leg stop 83 that is in permanent communication with said leg members at a predetermined location for limiting the insertion of said leg members and which provides for the matching heights of all separating members 75. Stop 83 may be a washer, a crimped portion of said leg members or of any other type stop means.

Drain rack device 1 can be used in either sink basin of a double sink. Whichever basin is used, drain rack device 1 will not interfere with the operation of water faucet assembly 7 and its pivotal faucet spout 8 for the unused sink basin.

Drain rack device 1 can also be used for a sink having only one sink basin by allowing the support ends of both inclined span members 66 and 70 to rest upon the top surfaces of the sink basin's adjacent countertops. In this case the entire drain rack device 1 would straddle the single sink basin.

Drain rack device 1 in its entirety can also be positioned atop a countertop or other horizontal surface with a shallow collection receptacle located beneath.

Drain rack device 1 may be designed to be linearly extendable or retractable by incorporating overlapping span members with guides, or the use of telescopic tubes depending upon the structural shape of the span members that are used. Those skilled in these type designs are quite familiar with their construction.

What is claimed is:

1. A draining rack for cooking receptacles containing hot or cold flowable cooking oils and/or greases comprising:

Two parallel horizontally inclined span members for spanning across a sink basin that contains a drain collection receptacle, each span member having a lower end and a higher end, wherein the lower ends of said span members are in permanent communication with a low drain rack support means, and wherein the higher ends of said span members are in permanent communication with a high drain rack support means;

Said low drain rack support means comprising at least one U-shaped leg member means for straddling and resting upon a double sink basin dividing partition wall;

Said high drain rack support means comprising at least one leg member means for resting upon the top surface of an adjacent sink countertop;

Said span members each comprising a series of spaced openings of equal size that penetrate perpendicularly to and completely through said span members, and wherein said openings on each said span member are parallel to one another and oppositely located across from one another, and wherein said openings are spaced in order to variably accommodate the predetermined placement of a single or a plurality and variety of different cooking receptacles having different widths and/or configurations;

A plurality of cooking receptacle separating members each comprising a horizontal supporting member, a proximal leg member and a distal leg member, wherein said proximal leg member is inserted into a said opening, and wherein said distal leg member is inserted into an oppositely located said opening;

A stop means located on each said proximal and distal leg member for limiting the insertion depth of said proximal and said distal leg members through said openings; and Said horizontal supporting members that each provide inclined support for a cooking receptacle by communicating with a front circular rim of said cooking receptacle, while also allowing said front circular rim to be supported upon the top surfaces of said span members, thus allowing the safe and efficient support and draining of cooking receptacles containing hot or cold flowable oils and/or greases into a drain collection receptacle and preventing said oils and/or greases from undesirably entering sink basin drain systems.

* * * * *